US006799546B1

(12) United States Patent
Gonring et al.

(10) Patent No.: US 6,799,546 B1
(45) Date of Patent: Oct. 5, 2004

(54) STARTING PROCEDURE FOR AN INTERNAL COMBUSTION ENGINE

(75) Inventors: Steven J. Gonring, Slinger, WI (US); Jeffery C. Ehlers, Neenah, WI (US); Robert E. Haddad, Oshkosh, WI (US); John R. Boatman, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 27 days.

(21) Appl. No.: 10/325,778

(22) Filed: Dec. 19, 2002

(51) Int. Cl.[7] ..... F02N 17/00
(52) U.S. Cl. ..... 123/179.3
(58) Field of Search ..... 123/179.2, 179.3, 123/179.4

(56) References Cited

U.S. PATENT DOCUMENTS

| | | | | |
|---|---|---|---|---|
| 4,473,025 | A | 9/1984 | Elliott | 114/211 |
| 4,809,199 | A | 2/1989 | Burgess et al. | 364/550 |
| 5,069,174 | A | 12/1991 | Kanno | 123/179 |
| 5,144,300 | A | 9/1992 | Kanno | 340/984 |
| 5,345,910 | A | 9/1994 | Remmers et al. | 123/424 |
| 5,531,619 | A | 7/1996 | Nakase et al. | 440/1 |
| 6,024,065 | A | 2/2000 | Hojna et al. | 123/179 |
| 6,273,771 | B1 | 8/2001 | Buckley et al. | 440/84 |
| 6,363,899 | B1 | 4/2002 | Koelle et al. | 123/179 |
| 6,481,404 | B1 | 11/2002 | Perry et al. | 123/179 |
| 2002/0008494 | A1 | 1/2002 | Nagao et al. | 318/778 |
| 2002/0145287 | A1 | 10/2002 | Izumiura et al. | 290/40 |

*Primary Examiner*—Mahmoud Gimie
*Assistant Examiner*—Arnold Castro
(74) *Attorney, Agent, or Firm*—William D. Lanyi

(57) ABSTRACT

A method for starting a marine internal combustion engine is independent of a continued signal received from a starting switch. If the operator of the marine vessel momentarily depresses a starting switch, a predetermined procedure is followed by a microprocessor which does not require continued involvement of the marine vessel operator. Various parameters are checked during the starting sequence and various actuators are activated to assure a safe and reliable starting procedure.

10 Claims, 3 Drawing Sheets

STARTING PROCEDURE FOR AN INTERNAL COMBUSTION ENGINE

BACKGROUND OF THE INVENTION

1. Field of the Invention

The present invention is generally related to a starting procedure for an internal combustion engine and, more particularly, to a starting procedure for a marine propulsion engine in which a microprocessor controls the starting procedure after receipt of a momentary signal manually provided by an operator of a marine vessel.

2. Description of the Prior Art

Many different types of starting procedures are well known to those skilled in the art.

U.S. Pat. No. 5,345,910, which issued to Remmers et al on Sep. 13, 1994, describes an engine ignition system having improved warm-up advanced timing control. The system provides reliable startup capability. It also provides two timing characteristics for discharging a capacitive discharge ignition, one of which is advanced relative to the other. The advanced timing is invoked at startup and is switched to regular timing in response to the engine temperature reaching a predetermined temperature from a temperature switch and also as a result of a circuit having a thermistor near the engine. The thermistor circuit may operate if the temperature switch does not, due to debris or the like preventing proper operation of a thermostat.

U.S. Pat. No. 5,531,619, which issued to Nakase et al on Jul. 2, 1996, describes a control device for a marine propulsion engine. The arrangement and structure for running a marine engine for a brief period of time after the engine cooling jacket has been depleted of water, so as to insure complete purging of water and water vapor from the engine is described. In the illustrated embodiment, this operation is initiated by actuation of the starter switch and a timer is starter to run only in the event the coolant is not in the engine for shutting of the engine after the lapse time has run.

U.S. Pat. No. 5,144,300, which issued to Kanno on Sep. 1, 1992, describes a starting device for a marine propulsion engine. An improved warning system for a marine propulsion unit that includes a starter, a starter switch, an ignition circuit having a kill switch for disabling the ignition circuit, a warning device and an abnormal operating condition sensor. The warning device is in circuit with the abnormal engine condition sensor and the device for sensing an attempt to start the engine with the kill switch enabled so that the single warning device will indicate either of the conditions.

U.S. Pat. No. 5,069,174, which issued to Kanno on Dec. 3, 1991, describes a fuel supplying device for a marine propulsion engine. Two embodiments of arrangements for precluding the discharge of fuel to an engine when its kill switch is enabled and the starter is operated. One embodiment relates to a fuel injected system and the other embodiment relates to a carbureted system.

U.S. Pat. No. 4,809,199, which issued to Burgess et al on Feb. 28, 1989, described a keyless access and engine control system. The system is caused to change from a dormant state to an enabled state when a sequence of actuation signals entered through a keypad matches data representing either one of two access sequences stored in the system's memory. When the system is in its enabled state, the system responds only to signals representing a keypad actuation exceeding a first predetermined time interval. These signals are used to crank, choke, and stop a marine vehicle engine. The secondary access sequence can be changed by a person who knows either the primary access sequence or the secondary access sequence, while the primary access sequence can be changed only by a person having knowledge of the present primary access sequence. In order to reprogram either access sequence, a programming button must be actuated for a predetermined time interval exceeding the first time interval. The system can be used with either a single or dual engine installation.

U.S. Pat. No. 4,473,025, which issued to Elliott on Sep. 25, 1984, describes a control circuit. A starter control circuit is disclosed having a particular utility in boats with inboard or inboard/outboard engines. The starter control circuit is coupled to the ignition switch and actuates a ventilation circuit prior to actuation of the starting circuit so that the engine compartment of the boat can be ventilated of any combustion fumes which may have accumulated therein prior to engine ignition.

U.S. patent application Ser. No. 10/107,220, which was filed by Izumiura et al on Mar. 28, 2002, describes an engine starting control system and method therefore. In order to improve the reliability of engine starting by using a motor, the engine cranking using the motor is started according to a request for starting the engine, and when the elapsed time from the starting time of the engine operation reaches a first predetermined time it is detected that the transmission is in the in-gear state, the engine cranking is continued if the engine speed is equal to or less than a predetermined engine speed defined for determining whether the engine reaches a predetermined starting phase. The engine cranking may be continued for a second predetermined time which is longer than the first predetermined time.

U.S. Pat. No. 6,481,404, which issued to Perry et al on Nov. 19, 2002, describes a vehicle starting method and system. A method for starting a motor vehicle having an internal combustion engine, an operator actuatable switch, an electric starter and a corresponding starter relay includes coupling a first control circuit to the starter relay during one or more crank operations and coupling a second a second control circuit to the starter relay during the one or more crank operations, the coupling steps resulting in a minimal delay time associated with the starting of the motor vehicle.

U.S. Pat. No. 6,363,899, which issued to Koelle et al on Apr. 2, 2002, describes a method for the starter cut-out of an internal combustion engine. The invention is directed to a method for turning off the starter of an internal combustion engine, wherein a starter motor which can be engaged with the internal combustion engine for cranking is disengaged and switched off when the internal combustion engine runs by itself, and the time at which the starter is switched off is determined from a curve of a starter current of the starter motor. It is provided that a signal proportional to the starter current is evaluated for determining the time for switching off the starter, wherein there is an evaluation of a characteristic line with a signal which is proportional to the starter current, which characteristic line is dependent on an operating state of the internal combustion engine.

U.S. patent application Ser. No. 09/907,661, which was filed by Nagao et al on Jul. 19, 2001, describes a self starting motor control device and method for an engine. A control device for driving a self starting motor for an engine is provided with a control means. If a starting switch is switched ON when a start enabling signal of a start limiting means and a non-start signal of a start detecting means are in an output condition, the control means puts a starting relay which supplies a starting motor with electricity in the ON-state for a predetermined time, only when the start enabling signal and the non-state signal are in the output condition.

U.S. Pat. No. 6,024,065, which issued to Hojna et al on Feb. 15, 2000, describes a starter motor control circuit and method. In a starter control system for an engine equipped with a starter motor, starter relay, ignition switch, and electronic control unit, a first circuit and method whereby the electronic control unit will deactivate the starter relay if the operator of a vehicle attempts to restart the vehicle when the measured engine speed is greater than the minimum engine running speed, under both initial starting and engine running conditions and a second circuit and method whereby the engine control unit will warn the vehicle operator if the starter pinion gear has not disengaged from the engine ring gear after the measured engine speed has exceeded the minimum engine running speed thereby eliminating the need for an overrunning clutch on the starter assembly.

U.S. Pat. No. 6,273,771, which issued to Buckley et al on Aug. 14, 2001, discloses a control system for a marine vessel. The control system incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

The patents described above are hereby expressly incorporated by reference in the description of the present invention.

In certain applications of internal combustion engines, it is difficult for the operator of the driven vehicle to hear the sound of the engine during the starting procedure. One example of this type of situation is a marine vessel, such as a vessel with an inboard drive system or a sterndrive system, where the engine can be located under sound-attenuating deck material. In this type of situation, the operator of the marine vessel may not be able to hear the engine as it is cranked during the starting procedure. As a result, the operator of the marine vessel may not know the required time duration to maintain the starting signal, which is generally an ignition key switch. It would therefore by significantly beneficial if a starting sequence can be completely controlled by an engine control unit subsequent to a momentary signal provided by the operator. The momentary signal can be a key switch and/or a push button.

SUMMARY OF THE INVENTION

A method for controlling the starting procedure of an internal combustion engine, in accordance with a preferred embodiment of the present invention, comprises the steps of providing the internal combustion engine which is connectable in torque transmitting relation with a propulsion system of a marine vessel, providing a first switch, connecting a microprocessor in signal communication with the first switch, and providing a starter motor connected in torque transmitting association with the internal combustion engine. It also comprises the steps of receiving a first signal from the first switch, which is received by the microprocessor, activating the starter motor subsequent to the first signal receiving step, measuring a preselected operating parameter associated with the internal combustion engine, and deactivating the starter motor if the preselected operating parameter does not achieve a predetermined status within a predetermined time period subsequent to the activating step.

The preselected operating parameter can be the operating speed of the internal combustion engine. The predetermined status can be an operating speed exceeding a minimal speed, which indicates rotation of the starter motor, within a very brief period of time which can typically be less than one second. The preselected operating parameter can also be the operating speed of the internal combustion engine, but with the predetermined status being an operating speed in excess of a speed magnitude that indicates that the internal combustion engine has been effectively started. That predetermined time period can be between one and three seconds, depending on the application.

A particularly preferred embodiment of the present invention further comprises the steps of providing a second switch and receiving a second signal from the second switch, wherein the second signal is received by the microprocessor. It also comprises the step of activating the starter motor subsequent to the first signal receiving step and also subsequent to the second signal receiving step. The second switch can be a manually operated push button and the first switch can be a key switch.

In a particularly preferred embodiment of the present invention, the method further comprises the step of providing a communication bus, wherein the microprocessor is connected in signal communication with the communication bus and a helm control unit is connected in signal communication with the communication bus.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
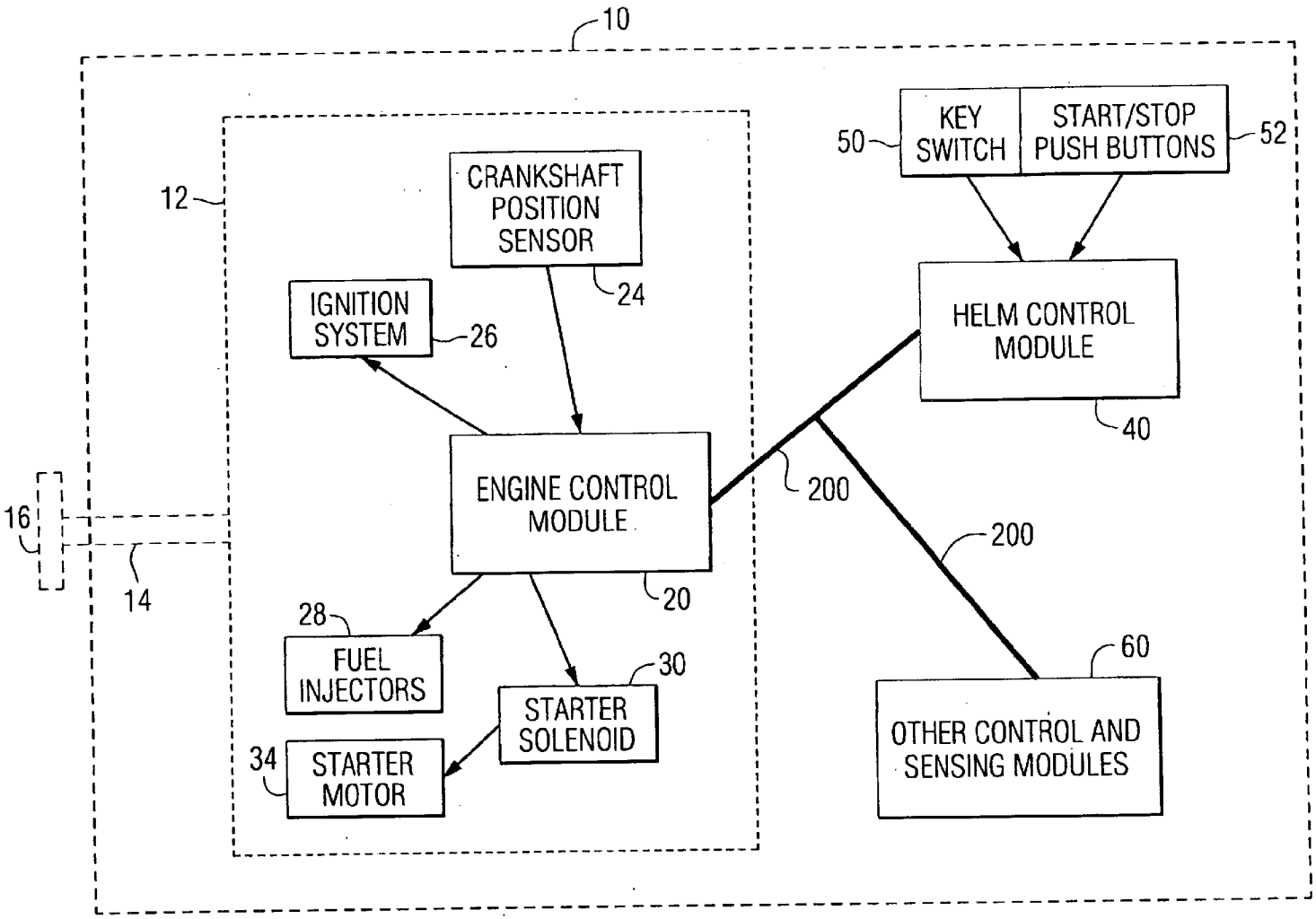
FIG. 1 is a simplified schematic representation of a marine vessel incorporating the necessary components to perform the method of the present invention.

Throughout the description of the preferred embodiment of the present invention, like components will be identified by like reference numerals.

FIG. 1 is a schematic representation showing the signal relationships between various devices used to implement the present invention. Dashed box 10 represents a marine vessel which has an internal combustion engine that is represented by dashed box 12. In a manner generally known to those skilled in the art, the engine 12 has a crankshaft that is connected in torque transmitting relation with a driveshaft 14 that causes a propeller 16, or alternative propulsion mechanism such as a jet pump, to propel the marine vessel 10. An engine control module (ECM) 20 is connected in signal communication with various sensors and actuators. For example, a crankshaft position sensor 24 provides a signal to the engine control module 20 that allows the engine control module to determine the rate at which the crankshaft of the engine 12 is rotating. The engine control module 20 provides outputs to the ignition system 26 and to the fuel injectors 28. These signals determine the timing at which the spark plugs are energized and also determine the timing relating to the injection of fuel by the fuel injectors 28. The engine control module 20 also provides a signal to a starter solenoid 30 which energizes a starter motor 34 that is connected in torque transmitting relation with the crankshaft of the engine 12. In a typical application of an internal combustion engine 12 as a marine propulsion device, the crankshaft of the engine 12 is connected directly to the driveshaft 14.

With continued reference to FIG. 1, a helm control module 40 is located at the helm of the marine vessel 10 and is connected in signal communication with various devices that allow the operator of the marine vessel to control its operation. For example, a key switch 50 and a set of push buttons 52 can be provided to allow the operator, who is located near the helm control module 40, to initiate a starting sequence that starts the engine 12. The present invention is most directly related to the starting sequence and the method through which it is controlled. Other control and sensing modules 60 can also be provided to assist the operator in the control of the marine vessel 10. These sensing modules can comprise sensors that detect the presence of gas fumes in the bilge of the marine vessel 10 and other sensors that detect various parameters relating to the marine vessel 10. The other controls associated with the other control and sensing modules 50 can include switches that allow various devices on the marine vessel to be deactivated momentarily during starting procedures or activated prior to starting the engine, such as a bilge blower.

Figure 2:
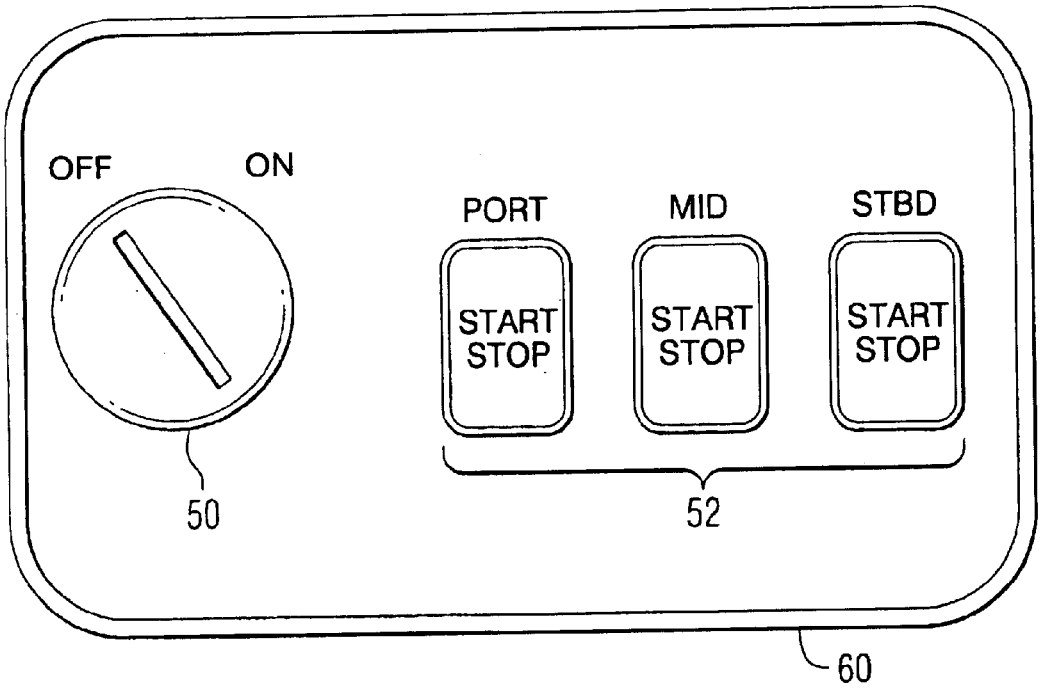
FIG. 2 shows a control pad that is usable in conjunction with the performance of the present invention.

FIG. 2 is a simplified illustration of a control panel 60 that can be located proximate the helm control module 40 and at the helm for easy access by the operator of the marine vessel 10. It can comprise a first switch, such as the key switch 50, which has an OFF position and an ON position. When in the ON position, the ignition system, the starting system, and the fuel ignition system for the marine vessel 10 are enabled. The illustration in FIG. 2 shows a second switch, such as the three push buttons 52, in which each operates as a START/STOP switch. In the illustration of FIG. 2, three push buttons are provided, one for each of three engines. It should be understood that the number of push buttons 52 are determined by the number of engines 12 used to propel the marine vessel 10.

With continued reference to FIG. 2, it should be understood that when the push buttons 52 are used in combination with a key switch 50, the push buttons 52 are only effective in starting or stopping the engine when the key switch 50 is in the ON position. Alternatively, the present invention can be implemented with a single switch which can be a key switch 50. In that type of implementation, the key switch would be provided with a START position in addition to the OFF and ON positions, in a manner generally similar to the way in which an ignition key of an automobile is configured. In that type of configuration, the key switch 50 could be used by the operator of the marine vessel 10 to stop the engines in either of two ways. One method would be to move the key switch 50 to the OFF position from the ON position. An alternative method could be to move the key switch 50 from the ON position to the START position when the engine is running.

Figure 3:
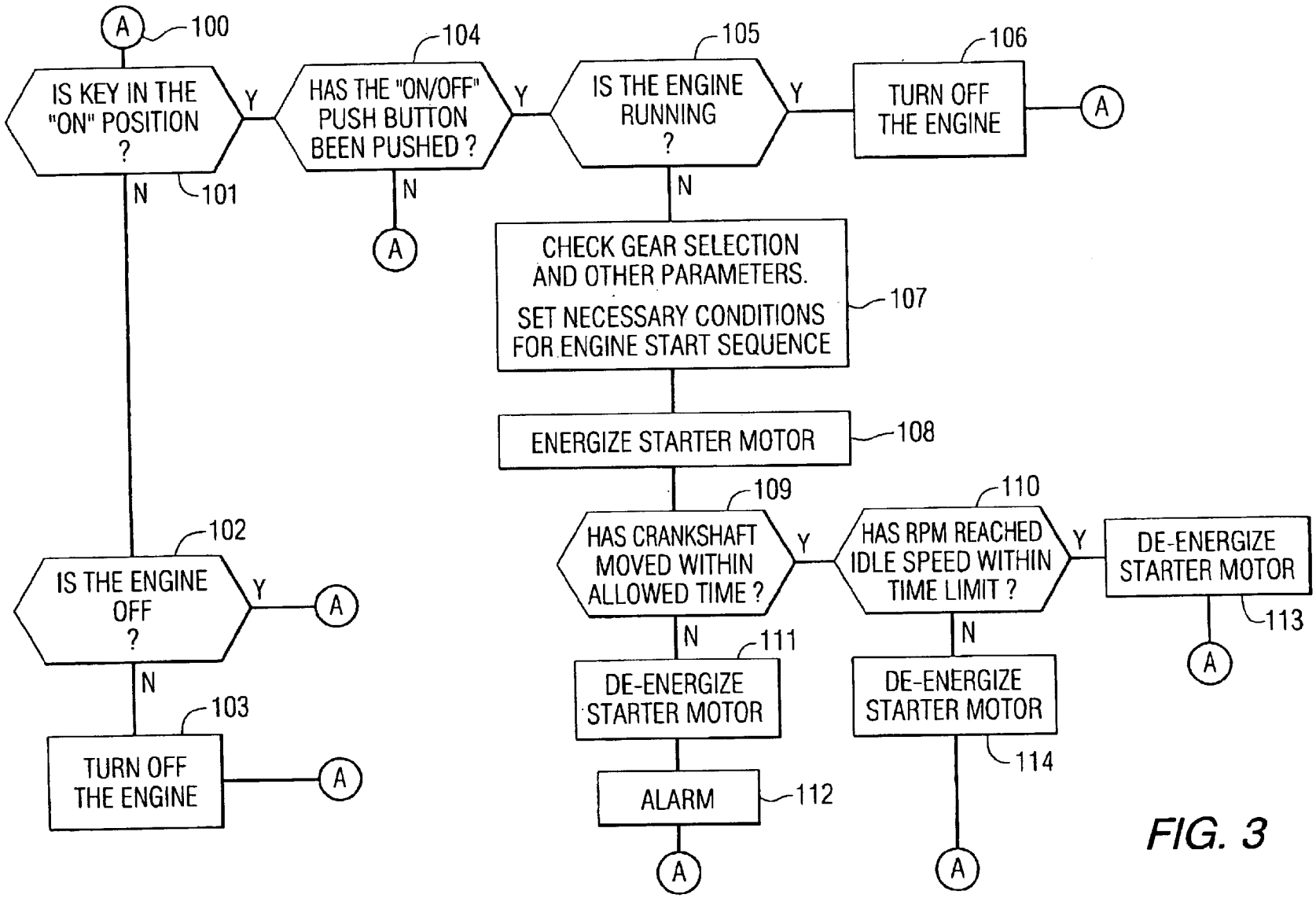
FIG. 3 is a simplified flow chart showing the various steps of the present invention.

FIG. 3 is a simplified flow chart showing the various steps performed during the operation of the present invention. It should be understood that the precise order of the steps shown in FIG. 3 and the relative positions of the various steps are not limiting to the present invention. In addition, the order of steps shown in FIG. 3 is intended to show the various operations performed during the execution of the method of the present invention and not the precise chronological relationships of those steps.

Beginning at the flow chart location identified as "A" and reference numeral 100, the method first checks to see if the key switch 50 is in the ON position. This is represented at functional block 101. If the key switch is not in the ON position, the engine is checked to see if it is not running. This is done by interrogating the crankshaft position sensor 24 by the engine control module 20. This determination is performed at functional block 102. If the engine is operating, it is turned off at functional block 103. If the engine is already in an OFF condition, the flow chart returns to the beginning step "A".

With continued reference to FIG. 3, functional block 104 shows an interrogation of the START/STOP push buttons 52. It should be understood that similar operational flow charts, like the ones shown in FIG. 3, would be relevant to each of the engines 12 used on the marine vessel 10. If no push button 52 is pushed, the program returns to the initial location "A" which is identified by reference numeral 100. If a push button is activated, as determined by functional block 104, the engine is checked to determine whether or not it is running. If it is running and the push button has been pushed, the engine is turned off at functional block 106. If the engine is not running, the activation of the push button is determined to mean that the operator of the marine vessel 10 desires that the engine be started. At functional block 107, the engine control module 20 checks various parameters, such as the gear selection and various safety sensors, such as a fuel vapor sensor located in the bilge of the marine vessel 10. As an example, the gear selection should be in a neutral gear position before the engine 12 is started. At functional block 107, the engine control module 20 also sets various conditions for the engine start sequence. These conditions could include a specific fuel injection rate or timing associated with the starting procedure. It can also include the deactivation of various non-critical electrical loads, such as lighting, to conserve electrical power during the starting procedure. It can also include the activation of a bilge blower, as a safety precaution, for a preselected period of time before starting the engine. After performing the various parameter check procedures and setting the necessary conditions identified in functional block 107, the starter motor is energized at functional block 108. This is accomplished by energizing the starter solenoid 30 which provides power to the starter motor.

With continued reference to FIG. 3, functional blocks 109 and 110 represent various parameter monitoring procedures performed by the engine control module 20. For example, at functional block 109, the crankshaft of the engine 12 is monitored to determine that it begins rotation within a relatively short period of time, such as less than one second. This check at functional block 109 is intended to avoid causing excess current to flow in a starter motor that is seized or unable to rotate for any reason. If the crankshaft does not begin to rotate within a minimal time limit, the starter motor is de-energized at functional block 111 and an alarm is provided at functional block 112 to notify the operator of the marine vessel 10 that the starter motor or the engine is unable to rotate. In most applications, the starter motor is connected in torque transmitting association with the crankshaft of the engine during the starting procedure. If, for any reason, the engine crankshaft or the starter motor rotor is unable to rotate, the de-energization at functional block 111 and the alarm at functional block 112 are intended to minimize any resulting damage to the starter motor. At functional block 110, the engine speed is monitored to determine whether or not the engine 12 has reached idle speed, or some other predetermined magnitude of speed, that indicates that the engine has appropriately begun to operate on its own. If the engine reaches this required operating speed within the preselected time limit, the starter motor 34 is de-energized at functional block 113. If, after a preselected period of time has elapsed, the engine 12 has not reached the preselected operating speed, the present invention determines that it is not starting as expected and the starter motor is de-energized at functional block 114.

With continued reference to FIG. 3, the time limit associated with functional block 110 can be approximately 2 to 3 seconds, in a particularly preferred embodiment, whereas the time limit associated with functional block 109 will typically be less than one second. It should be understood that alternative embodiments of the present invention could use other magnitudes as the time limits. The test represented at functional block 109 is intended to detect a stalled or seized starter motor. It should also be understood that functional block 107 represents a plurality of parameter monitoring steps and a plurality of condition setting steps. In addition to checking whether the gear selection is in neutral gear position and gas fumes are not present in the bilge, the present invention can also activate a bilge blower fan and/or move the gear selector into the neutral position. It should be understood that these are optional characteristics of the present invention and not necessary in all applications.

With reference to FIGS. 1–3, it should be understood that certain embodiments of the present invention can use a single switch alone, such as the key switch 50. It should also be understood that a momentary activation of the switch initiates the procedures shown in FIG. 3 without the necessity that the operator maintain the switch in an activated position. As an example, when the key switch 50 (i.e. the first switch) is used in combination with the START/STOP push buttons 52 (i.e. second switches), the operator of the marine vessel 10 can momentarily depress one of the push buttons 52 and then release it without having to hold it down in an activated as the engine is cranked by the starter motor. After momentarily depressing the appropriate push button, the engine control module 20 continues to perform the steps and interrogations shown in FIG. 3. Unlike ignition systems that are well known to those skilled in the art, the procedures shown in FIG. 3 do not cease when the operator releases the push button.

In a particularly preferred embodiment of the present invention, a communication bus 200 is provided on the marine vessel 10 in a manner described in U.S. Pat. No. 6,273,771. This type of communication bus allows the various components shown in FIG. 1 to be connected to the bus without having to be directly connected to each other. This also allows the use of a helm control module 40 in combination with an engine control module 20 and other control and sensing modules 60 that are spaced throughout the marine vessel 10. With the helm being located at a significant distance from the engine 12 in many applications, the operator of the marine vessel 10 may not be able to hear the engine 12 as the starting procedure begins. Therefore, it is difficult for the operator of the marine vessel 10 to know when to release the ignition start key from its starting position in ignition systems generally known to those skilled in the art. The present invention, on the other hand, does not require the operator of the marine vessel 10 to maintain the starting switch in an activated position as in known systems.

With reference to FIGS. 1–3, the method of the present invention for controlling the starting procedure of an internal combustion engine 12 comprises the steps of providing the internal combustion engine 12 which is connectable in torque transmitting relation with a propulsion system, such as the driveshaft 14 and propeller 16, of a marine vessel 10. It also comprises the step of providing a first switch 50 and a second switch 52. It connects the microprocessor, or engine control module 20 in signal communication with the first switch 50 and the second switch 52. It provides a starter motor 34 that is connected in torque transmitting association with the internal combustion engine 12 and particularly in torque transmitting relation with the crankshaft of the engine 12. The present invention receives a first signal from the first switch 50 by the microprocessor 20 and activates the starter motor 34 subsequent to receipt of the signal. The engine control module 20 receives a measured parameter associated with the internal combustion 12, such as its rotational speed measured by a crankshaft position sensor. The starter motor 24 is deactivated if the preselected operating parameter does not achieve a predetermined status within a predetermined time period subsequent to the activating step. This deactivating step can comprise either functional block 109 or 110, or both in a particularly preferred embodiment. The operating speed of the internal combustion engine 12 is monitored by the crankshaft position sensor 24. Throughout the description of the present invention, it should be understood that the first signal in some embodiments is characterized in terms of powering the microprocessor. In other words, the key switch may not provide a distinct signal, in the normal sense, but instead provide power to the system. As such, the power provided to the microprocessor and other devices acts as a first signal by enabling the further process steps of the present invention described herein.

As described above, the preselected operating parameter can be the operating speed of the internal combustion engine 12 and the predetermined status can be the achievement of a minimum threshold speed, such as any slight movement of the crankshaft, within a minimum time such as one second or less. This is the type of check described at functional block 109 relating to the detection of a seized or stalled starter motor. It should also be understood that the preselected operating parameter of operating speed can be used in conjunction with a predetermined status of being either above or below a minimum operating speed such as an idle speed and the predetermined time period can be between two and three seconds. The first switch can be a manually operated key switch 50 and the second switch can one of the set of push buttons 52. The number of switches in the set of push buttons 52 will depend on the number of engines being controlled. Alternatively, a single key switch 50 can be used as the first switch without the combination of the push buttons 52. The first signal is a momentary signal and the activating step, in which the procedure shown in FIG. 3 are performed, is not dependent on the first signal being maintained subsequent to the initial receipt of the first signal. A second switch 52 can be provided and a second signal is received from the second switch by the microprocessor 20. The starter motor 34 can be activated upon the receipt of both the first signal and the second signal. In other words, the key switch must be on and one of the push buttons 52 must be depressed momentarily.

Although the present invention has been described in particular detail, it should be understood that alternative embodiments are also within its scope.

We claim:

1. A method for controlling the starting procedure of an internal combustion engine, comprising the steps of:

providing said internal combustion engine which is connectable in torque transmitting relation with a propulsion system of a marine vessel;

providing a first switch;

connecting a microprocessor in signal communication with said first switch;

providing a starter motor connected in torque transmitting association with said internal combustion engine;

receiving a first signal from said first switch, said first signal being received by said microprocessor;

activating said starter motor subsequent to said first signal receiving step;

measuring a preselected operating parameter associated with said internal combustion engine; and deactivating said starter motor if said preselected operating parameter does not achieve a predetermined status within a predetermined time period subsequent to said activating step, said preselected operating parameter being the operating speed of said internal combustion engine, said predetermined status is achievement of a minimum threshold speed indicating movement of a crankshaft of said internal combustion engine.

2. The method of claim 1, wherein:

said predetermined time period being a magnitude which is less than one second.

3. The method of claim 1, wherein:

said first switch is a manually operated key switch.

4. The method of claim 1, wherein:

said first signal from said first switch is a momentary signal.

5. The method of claim 1, wherein:

said activating step is not dependant on said first signal being maintained subsequent to said first signal receiving step.

6. The method of claim 1, further comprising:

providing a second switch;

receiving a second signal from said second switch, said second signal being received by said microprocessor; and activating said starter motor subsequent to said first signal receiving step and said second signal receiving step.

7. The method of claim 6, wherein:

said second switch is a manually operated pushbutton.

8. The method of claim 6, wherein:

said second signal is momentary; and said activating step is not dependant on said second signal being maintained subsequent to said second signal receiving step.

9. The method of claim 1, wherein:

said internal combustion engine is a marine propulsion engine.

10. The method of claim 1, further comprising:

providing a communication bus, said microprocessor being connected in signal communication with said communication bus; and connecting a helm control unit in signal communication with said communication bus.

* * * * *